US008648531B2

(12) United States Patent
Yokota et al.

(10) Patent No.: US 8,648,531 B2
(45) Date of Patent: Feb. 11, 2014

(54) HIGH PRESSURE DISCHARGE LAMP AND METHOD OF MANUFACTURING HIGH PRESSURE DISCHARGE LAMP

(75) Inventors: Toshio Yokota, Shizuoka (JP); Yukio Yasuda, Hyogo (JP); Hiroyuki Daido, Fukui (JP); Hiromitsu Kiriyama, Kyoto (JP); Hajime Okada, Kyoto (JP); Masayuki Suzuki, Kyoto (JP); Izuru Daito, Kyoto (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 260 days.

(21) Appl. No.: 12/926,067

(22) Filed: Oct. 25, 2010

(65) Prior Publication Data

US 2011/0095683 A1 Apr. 28, 2011

(30) Foreign Application Priority Data

Oct. 23, 2009 (JP) ..... 2009-244555

(51) Int. Cl.
*H01J 17/18* (2012.01)

(52) U.S. Cl.
USPC ..... 313/623; 313/284; 313/286; 313/292

(58) Field of Classification Search
USPC ..... 313/284–288, 331, 332, 491, 632, 625, 313/631, 623, 580, 583, 252, 261
See application file for complete search history.

(56) References Cited

U.S. PATENT DOCUMENTS

| | | | | |
|---|---|---|---|---|
| 5,200,669 | A * | 4/1993 | Dixon et al. | 313/623 |
| 6,433,479 | B1 * | 8/2002 | Higashimoto et al. | 313/623 |
| 6,903,509 | B2 | 6/2005 | Kanzaki | |
| 2003/0048078 | A1 * | 3/2003 | Fukuyo et al. | 313/631 |
| 2003/0107320 | A1 * | 6/2003 | Kanzaki et al. | 313/623 |
| 2005/0003729 | A1 * | 1/2005 | Mizobe | 445/22 |
| 2010/0259169 | A1 * | 10/2010 | Shirakawa et al. | 313/623 |

FOREIGN PATENT DOCUMENTS

| | | | |
|---|---|---|---|
| JP | 3283265 | B2 | 3/2002 |
| JP | 3570414 | B2 | 7/2004 |
| JP | 2006-114240 | * | 4/2006 |
| WO | WO-95/27587 | A1 | 10/1995 |
| WO | WO2007086527 | * | 8/2007 |

* cited by examiner

*Primary Examiner* — Anh Mai
*Assistant Examiner* — Fatima Farokhrooz
(74) *Attorney, Agent, or Firm* — Rader, Fishman & Grauer PLLC

(57) ABSTRACT

A high pressure discharge lamp has a sealing portion that is made of glass and a sealing metal piece. In a method of manufacturing the high pressure discharge lamp, the sealing metal piece is irradiated with laser beam whose pulse width is $1\times10^{-9}$ seconds or less, so as to carry out a surface treatment of the sealing metal piece. The sealing metal piece may have a groove that is 120 to 600 nm in depth and 450 to 1,200 nm in width.

14 Claims, 15 Drawing Sheets

FIG.7A
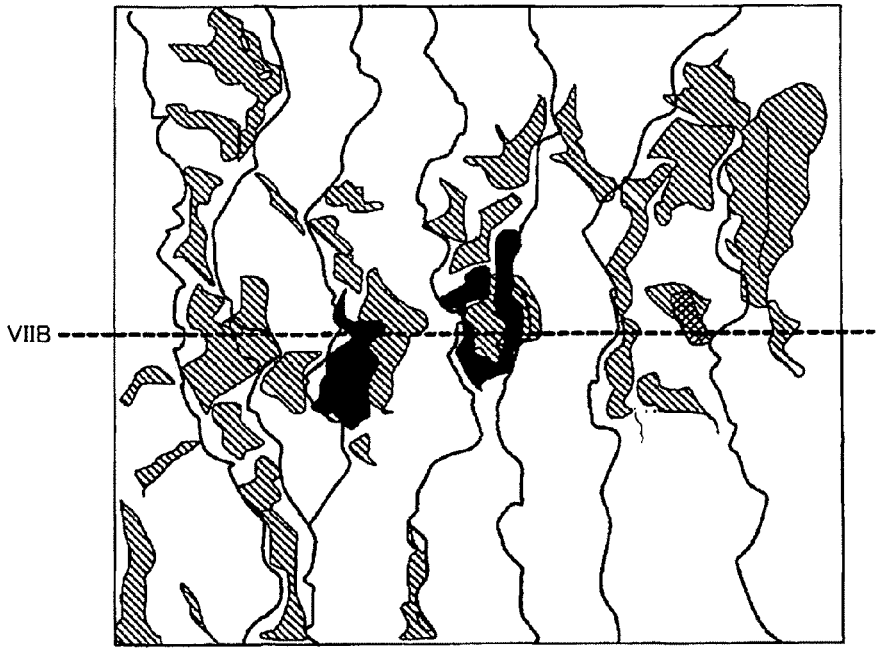
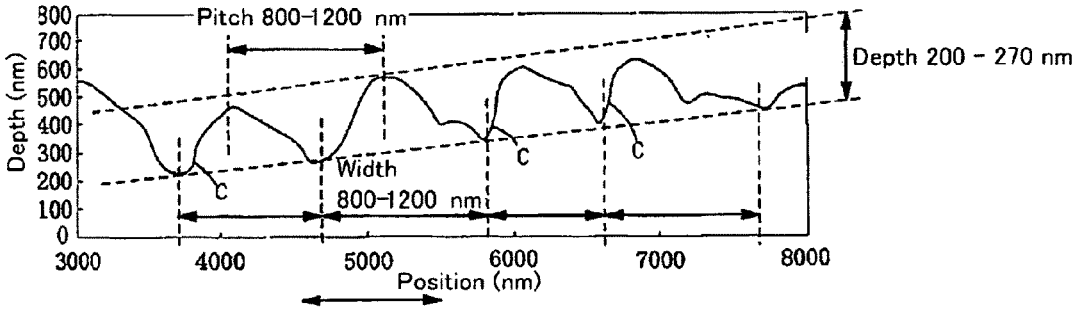
FIG.7B

FIG.8A
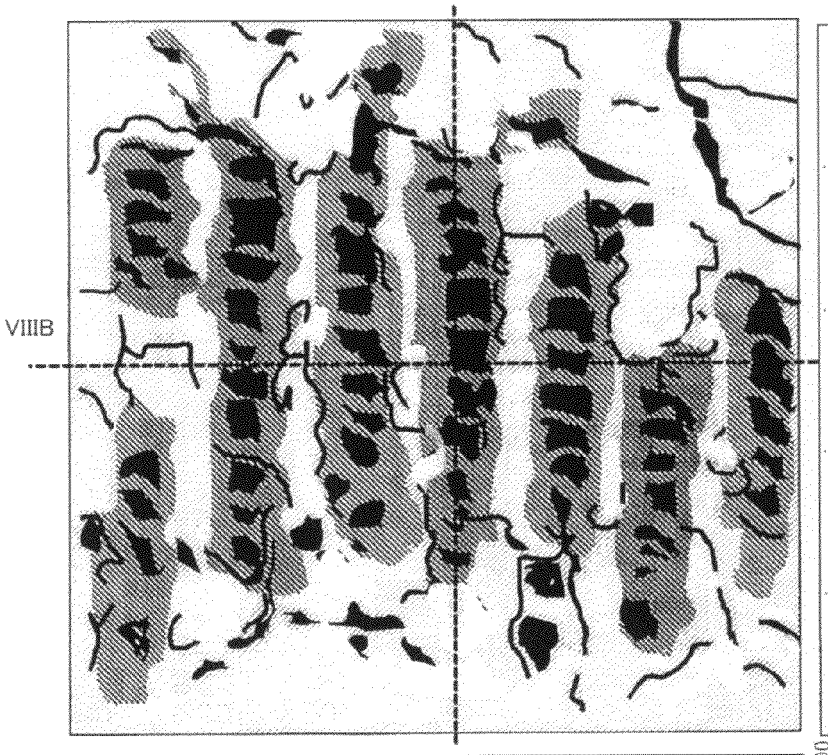
FIG.8C
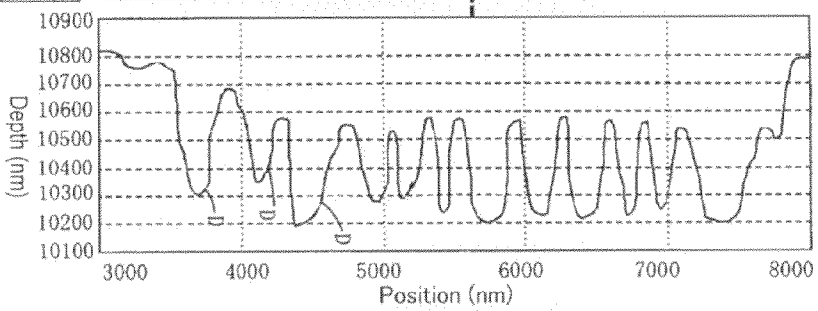
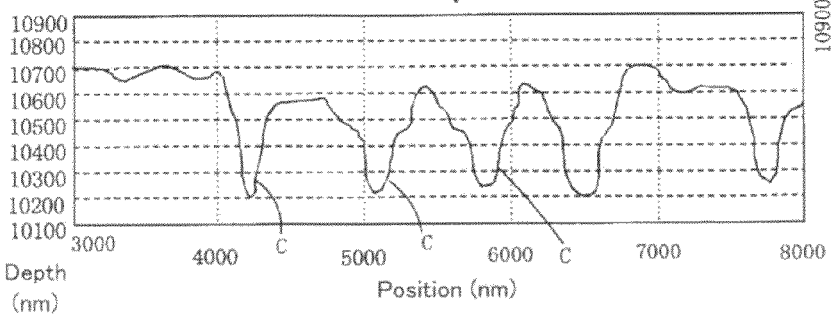
FIG.8B

| | | Femtosecond laser | Picosecond laser | |
|---|---|---|---|---|
| Performance | Pulse width | 30 fs | 65 ps | 410ps |
| | Repeat | 1kHz | 1kHz | 1kHz |
| | Energy | 400～660 μ J | 900～1000 μ J | 900～1000 μ J |
| | Average power | 400～660mW | 900～1000mW | 900～1000mW |
| | Wavelength | 800nm | 1064nm | 1064nm |
| | Peak power | 22GW | 15MW | 2. 4MW |
| | | | | |
| Focus point | Beam diameter | 0. 2 mm φ | 0. 2 mm φ | 0. 2 mm φ |
| | I.P.D | 70TW/cm$^2$ | 47GW/cm$^2$ | 7. 6GW/cm$^2$ |
| | | | | |
| Groove process | Groove depth | 120～155nm | 200～270nm | 200～270nm |
| | Groove width | 450～500nm | 800～1200nm | 800～1200nm |
| | Groove pitch | 450～500nm | 800～1200nm | 800～1200nm |
| | | | | |
| Moving system | Moving speed | 0. 5～5mm/s | 0. 5～5mm/s | 0. 5～5mm/s |
| | Pitch | 0. 5mm | 0. 5mm | 0. 5mm |

FIG.10

| Lamp No. | Pulse width of laser beam | Metal foil Separation dist. (Acceleration lighting method) | Evaluation | Note |
|---|---|---|---|---|
| Lamp A0 | No laser | 1 2 mm | × | No groove |
| Lamp B1 | 410 psec | 1 mm | ○ | Ladder grooves |
| Lamp B2 | 65 psec | 1 mm | ○ | Same as above |
| Lamp B3 | 30 fsec | 4 mm | △ | Concave grooves |

FIG.14

HIGH PRESSURE DISCHARGE LAMP AND METHOD OF MANUFACTURING HIGH PRESSURE DISCHARGE LAMP

CROSS-REFERENCES TO RELATED APPLICATION

This application claims priority from Japanese Patent Application Serial No. 2009-244555 filed Oct. 23, 2009, the contents of which are incorporated herein by reference in their entirety.

TECHNICAL FIELD

The present invention relates to a high pressure discharge lamp, which has a seal structure, such as a foil seal and a rod seal, and a method of manufacturing the high pressure discharge lamp.

BACKGROUND

The technology of changing a state of material, such as an ablation or denaturation of physical properties, by irradiating the material with a laser pulse having a short pulse width is attracting attentions in recent years (for example, refer to Japanese Patent No. 3283265 and "*Femuto Byo Tekunoroji—Kiso to Oyo*— (Femtosecond Technology—Foundation and Application—)", Kagaku-Dojin Publishing Company, Inc., Kazuyuki Hirao et al., Mar. 30, 2006 (1st edition, 1st issue), pp. 1-13, and pp. 125-134) (hereinafter referred to as the "Non-patent Literature"). Conventionally, as disclosed in the Non-patent Literature and Japanese Patent No. 3283265, a laser ablation of a metal material using the above-mentioned short pulse width is carried out on metal, such as gold and copper, whose melting point is comparatively low. Contrarily, when the laser ablation is carried out to metal, such as molybdenum (Mo) or tungsten (W), which have comparatively high melting points, the obtained effects have not been verified.

Further, technology, such as that disclosed, for example, in Japanese Patent No. 3570414, regarding preventing a discharge medium from leaking out of a high pressure discharge lamp's arc tube when a discharge medium is being enclosed in the arc tube has been developed. Specifically, Japanese Patent No. 3570414 approaches leak prevention by making its sealing portions, which are made of glass and sealing metal pieces, of its high pressure discharge lamp into a special shape with the goal of improving the adhesion strength between the glass and the sealing metal pieces to more airtightly seals the arc tube's sealing portions.

Although the above references do disclose technologies, the separation problem of the glass and the sealing metal pieces is not fully solved. The present invention solves this problem and improves the adhesion strength between the glass and the sealing metal pieces in a sealing portion of a high pressure discharge lamp.

SUMMARY

The present invention relates to a high pressure discharge lamp and a method of manufacturing a high pressure discharge lamp having a sealing portion constructed of glass and a sealing metal piece, wherein surface treatment of the sealing metal piece is carried out by irradiating the sealing metal piece with a laser beam whose pulse width is $1\times10^{-9}$ seconds or less.

Further, the pulse width of the laser beam may be $2\times10^{-11}$ seconds to $1\times10^{-9}$ seconds.

Furthermore, the sealing metal piece may be a foil or rod shape.

Further, a groove may be formed on a surface of the sealing metal piece by performing a surface treatment of the sealing metal piece, and a depth of the groove may be in a range of 120 to 600 nm.

Furthermore, the depth of the groove may be in a range of 450 to 1,200 nm and may be a concave shape with a ladder-like groove formed inside.

Further, the laser beam may have a linear polarization.

BRIEF DESCRIPTION OF THE DRAWINGS

Other features and advantages of the present high pressure discharge lamp and the present method of manufacturing high pressure discharge lamp will be apparent from the ensuing description, taken in conjunction with the accompanying drawings, in which:

FIGS. 7A and 7B are schematic diagrams showing a fine cycle structure formed by irradiating a metal piece with a laser beam whose pulse width is $2\times10^{-11}$ to $1\times10^{-9}$ seconds and that was viewed by an atom force microscope;

FIGS. 8A, 8B and 8C are schematic diagrams showing a fine cycle structure formed by irradiating a metal piece with a laser beam whose pulse width is $2\times10^{-11}$ to $1\times10^{-9}$ seconds, which are viewed by an electron scanning microscope;

FIG. 10 is a table showing a performance of laser used for an experiment;

FIG. 14 shows an experimental result.

DESCRIPTION

Figure 1A:
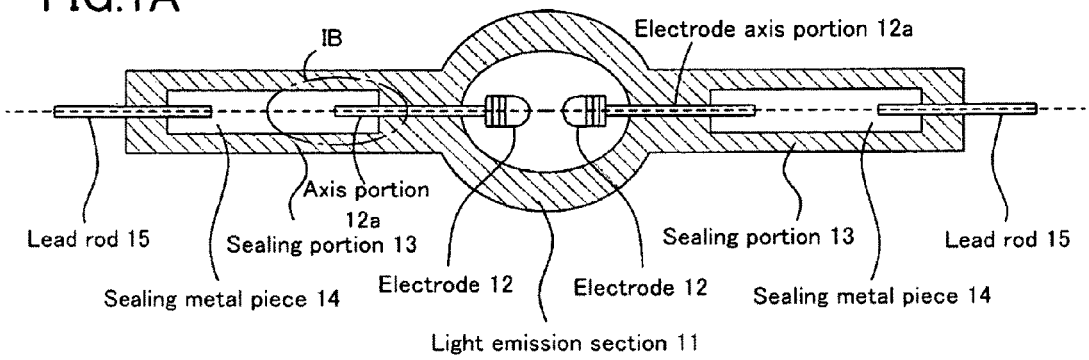
FIGS. 1A, 1B, and 1C are diagrams showing the structure of a high pressure discharge lamp according to a first embodiment of the present invention, wherein sealing metal pieces, to which a surface treatment is performed, are used.

IN a high pressure discharge lamp and method of manufacturing, the sealing portion are constructed of glass and sealing metal pieces. Each of the sealing portions are formed by arranging the sealing metal pieces inside the arc tube and heating the sealing portions by any one of various heating units from the outside of the sealing metal piece to melt and deform the sealing portions. In the sealing portions, the thermal expansion coefficient of the sealing portions made of glass and that of the sealing metal piece, which may be, for example, molybdenum, differ so that the adhesion strength between the glass and the sealing metal piece is low. This is because the thermal expansion coefficient of the glass is one digit smaller than that of the sealing metal pieces, that is, when the temperature of the sealing portions fluctuate by repeated lighting and turning off of the high pressure discharge lamp and since the amount of expansion of glass and that of the sealing metal pieces are different, the adhesion strength becomes low.

For this reason, that is since the glass and the sealing metal piece are separated at time of lighting of the high pressure discharge lamp, there is a problem where the discharge medium enclosed in the arc tube leaks out and the lamp's life span decreases. Consistently, since luminance improvements of the high pressure discharge lamp are in demand in recent years, higher discharge medium amounts are enclosed in the arc tube. Thus, since the pressure in the arc tube at time of lighting is very high, there is a problem that the glass and the sealing metal piece tend to separate.

As mentioned above, various measures have been taken to deal with the problem of the separation of such arc tube material and the sealing metal pieces, although the technology of solving the separation problem of the arc tube structure material from the sealing metal pieces by improving the adhesion strength between such glass and sealing metal piece, as disclosed in Japanese Patent No. 3570414, are not fully complete. The present invention solves the problem of the above-mentioned references. Further, it is an object of the present invention to improve the adhesion strength between glass and a sealing metal piece(s) in a sealing portion of a high pressure discharge lamp, which is made up of the glass and the sealing metal piece.

To solve the above-mentioned problem, the present inventors studied various methods of improving the adhesion strength between glass and sealing metal piece. When the sealing metal piece, which is made of, for example, molybdenum (Mo) or tungsten (W), was irradiated with laser beam whose pulse width is $1\times10^{-9}$ seconds or less to carry out a surface treatment of the sealing metal piece, the inventors found that the adhesion strength between glass and the sealing metal piece was remarkably improved compared to the references. It would appear that a particular fine surface structure is formed on a surface of the sealing metal piece by irradiating the sealing metal piece with the laser beam of the above-mentioned pulse width, and when a sealing portion is formed from glass and the sealing metal piece, which has such a treated surface structure, it is possible to increase the adhesion strength between the sealing metal piece and glass. Based on these contemplations, the present invention solves the above-mentioned problem, as set forth below.

In a high pressure discharge lamp that has a sealing portion made of glass and a sealing metal piece, the sealing metal piece is irradiated with laser beam whose pulse width is $1\times10^{-9}$ seconds or less to carry out a surface treatment. The laser beam may have a linear polarization. In addition, a laser oscillator, such as, for example, a picosecond laser oscillator and a femtosecond laser oscillator, capable of emitting the above-mentioned laser beam whose pulse width is $1\times10^{-9}$ seconds or less may be used.

The may be treated into a foil or a rod shaped sealing metal piece. Further, the sealing metal piece may be irradiated with the laser beam whose pulse width is $2\times10^{-11}$ seconds to $1\times10^{-9}$ seconds (hereinafter referred to as picosecond laser beam) to carryout a surface treatment of the sealing metal piece. The depth of grooves formed by a surface treatment with the picosecond laser beam may be 200-270 nm, and the width of the grooves is 800-1200 nm. Moreover, the grooves, which are formed on the surface of the sealing metal piece by irradiating the sealing metal piece with the picosecond laser beam may have a ladder-like groove shape that is formed inside the concave groove.

According to the present invention, since the sealing metal piece is irradiated with the laser beam whose pulse width is $1\times10^{-9}$ seconds or less so as to carry out a surface treatment of the sealing metal piece of a high-voltage discharge lamp, a fine surface structure is formed on the sealing metal piece that increases the adhesion strength between the sealing metal piece and glass. Consequently, even if the temperature of the sealing portion fluctuates when repeating lighting and turning off of the high pressure discharge lamp, a problem of delamination, in which the sealing metal piece separates from the glass, hardly arises, and the life span of the high pressure discharge lamp remarkably extends.

Figure 1B:
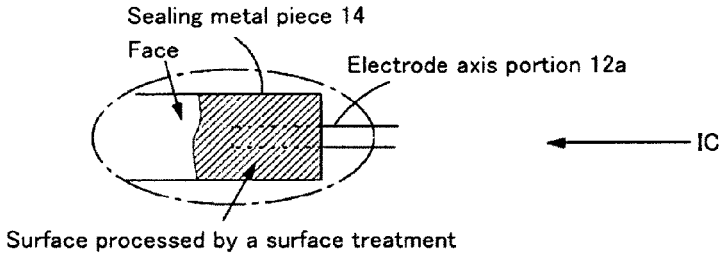
Figure 1C:
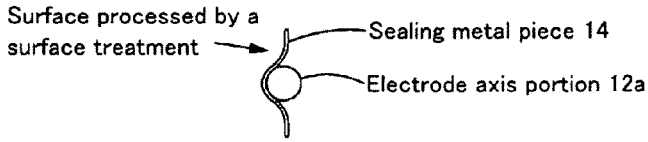

FIGS. 1A, 1B, and 1C are drawings showing the structure of a high pressure discharge lamp according to a first embodiment of the present invention, wherein a metal piece, on which a surface treatment is performed, is used for the high pressure discharge lamp. Specifically, FIG. 1A is a cross sectional view of the high pressure discharge lamp, taken along a longitudinal direction. FIG. 1B is a partially enlarged view of a portion IB of FIG. 1A. FIG. 1C is a side view of the portion IB, which is viewed in an arrow IC of FIG. 1B. The high pressure discharge lamp shown in FIG. 1A has an arc tube, which is made up of a spherical light emission section 11 and rod shape sealing portions 13 extending from the respective ends of the light emission section 11 towards the outside in an the axial direction of the arc tube. While a pair of electrodes 12 is arranged to face each other, mercury is enclosed inside the arc tube, as the discharge medium. Mercury of 0.15 mg/mm$^3$ or more is enclosed, so that the pressure in the interior space of the arc tube may become 150 atmospheric pressure or more at time of lighting. In addition to the mercury, rare gas, and halogen gas are enclosed in the interior space of the arc tube. In order that a halogen cycle may be efficiently carried out by halogen gas in the interior space of the arc tube, the halogen gas with an amount range of $10^{-6}$ to $10^{-2}$ μmol/mm$^3$, is enclosed. To improve lighting starting nature, argon gas whose pressure is 13 kPa, is enclosed, as the rare gas.

In each rod shape sealing portion 13, a molybdenum foil processed by a surface treatment that is carried out by irradiating the foil with laser beam with a pulse width of $1\times10^{-9}$ seconds or less, is airtightly buried as a sealing metal piece 14. An axis portion 12*a* of each electrode 12 is electrically connected to a tip side of the molybdenum foil (sealing metal piece 14) by welding. A lead rod 15 for electric supply that projects outward from an outer end face of each sealing portion 13 is electrically connected to a base end side of the molybdenum foil by welding in a similar manner to that of the electrode 12. As shown in FIGS. 1B and 10, a face A of the molybdenum foil (sealing metal piece 14) in the electrode 12 side, which is opposite to the face where at least the electrode is welded, is irradiated with the laser whose pulse width is $1\times10^{-9}$ seconds or less, so that the surface treatment is performed. Thus, a fine surface structure is formed on the surface of the molybdenum foil, so that the adhesion strength between glass of the sealing portion 13 and the molybdenum foil increases. In addition, although in the above description, the surface treatment is carried out on the face that is opposite to the face of the electrode 12 of the molybdenum foil (sealing metal piece 14), on which at least the electrode is welded, the entire surfaces of both sides of the molybdenum foil or the entire surface of one of the faces is irradiated with the laser beam to carry out the surface treatment.

Figure 2A:
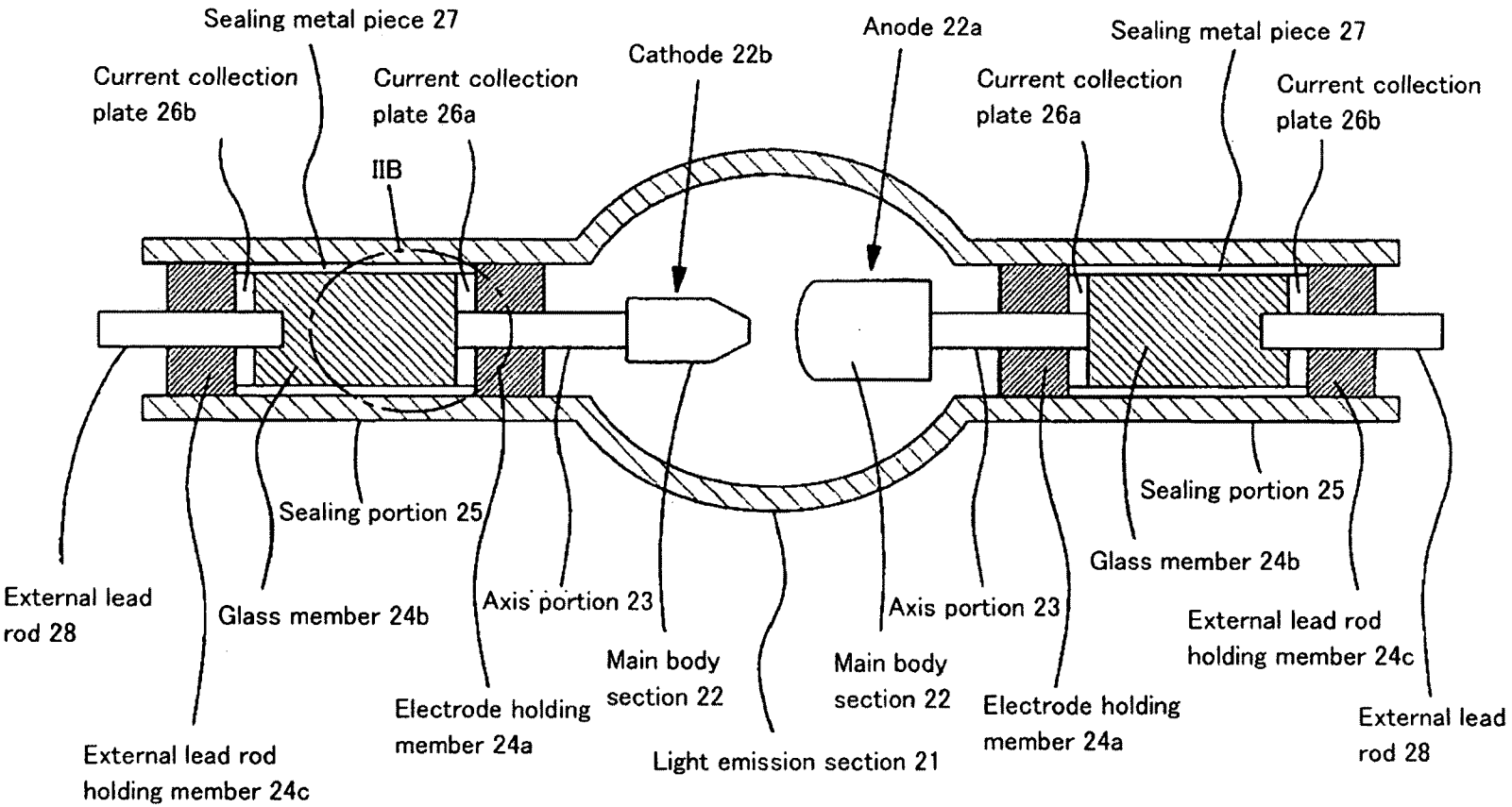
FIGS. 2A through 2D are diagrams showing the structure of a high pressure discharge lamp according to a second embodiment of the present invention, wherein sealing metal pieces, to which a surface treatment is performed, are used.
Figure 2C:
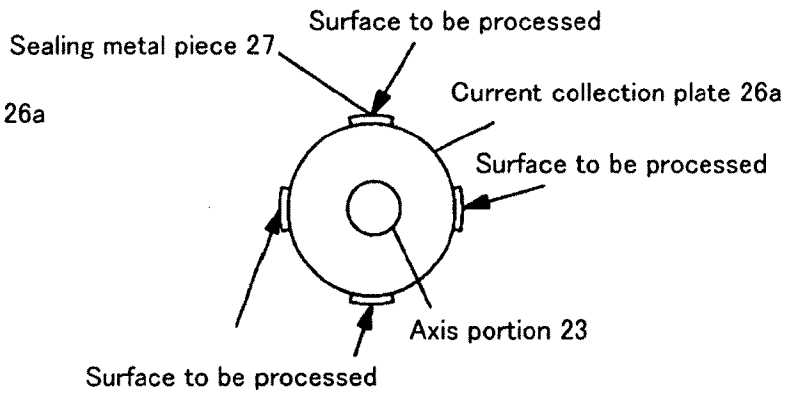
Figure 2D:
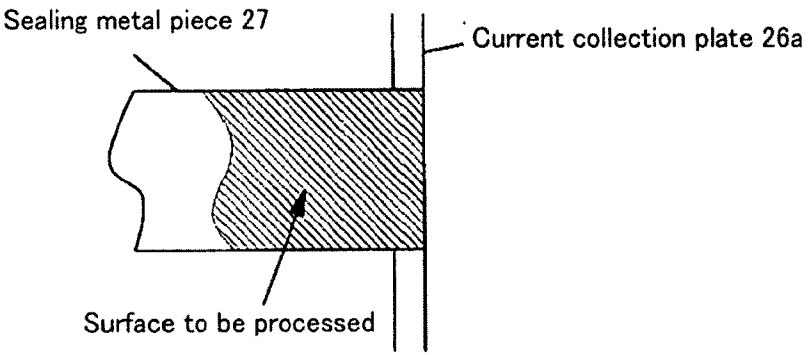
Figure 2B:
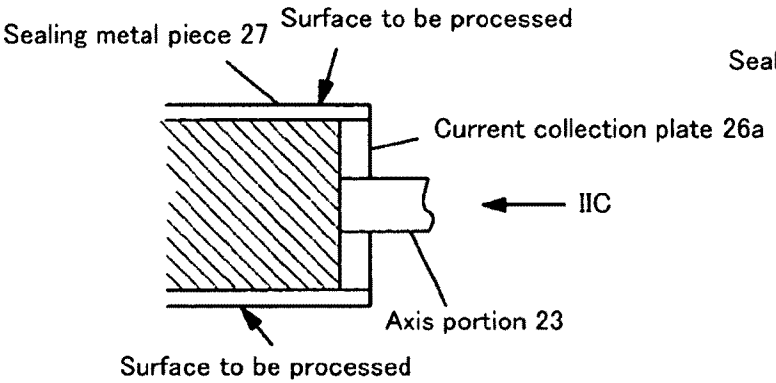

FIGS. 2A, 2B, 2C, and 2D are drawings showing the structure of the high pressure discharge lamp of a second embodiment of the present invention, wherein sealing metal pieces, to which a surface treatment is performed, are used. Specifically, FIG. 2A is a cross sectional view of the high pressure discharge lamp, taken along a longitudinal direction thereof; FIG. 2B is a partially enlarged view of the sealing metal piece, taken along a circle line IIB of FIG. 2A; and FIG. 2C is a side view of the sealing metal piece shown in FIG. 2B, which is viewed in a direction of an arrow IIC of FIG. 2B. The high pressure discharge lamp shown in FIG. 2A comprises an arc tube, which consists of a light emission section 21 and sealing portions 25, an anode 22*a*, and a cathode 22*b* that form a pair of electrodes where each electrode is made up of a main body section 22, an axis portion 23, electrode holding members 24*a*, current collection plates 26*a* and 26*b*, glass members 24*b*, external lead rods 28, external lead rod holding members 24*c*, and two or more molybdenum foils that are sealing metal pieces 27. The arc tube is made of quartz glass and has the spherical light emission section 21 and the cylindrical sealing portions 25, which are continuously formed from both ends of the spherical light emission section 21, respectively. As discharge medium, mercury and rare gas are enclosed in the interior space of the light emission section, so that the vapor pressure may become a predetermined pressure at time of lighting. The pair of electrodes 22*a* and 22*b*, each being made of tungsten, is arranged to face each other in the interior space of the light emission section 21.

Each of the electrodes 22*a* and 22*b* consists of the main body section 22 and the axis portion 23, and while the entire main body section 22 is projected in the interior space of the light emission section 21, the end portion of the axis portion 23 is held by the electrode holding member 24*a* made from a cylindrical quartz glass member, and an end portion of the axis portion 23 is electrically connected to the current collection plate 26*a*. The glass member 24*b* is arranged inside the sealing portion 25. As shown in FIG. 2C, the four sealing metal pieces 27, each of which are made from, for example, a molybdenum foil, are provided on circumference of the disk-like current collection plates 26*a* and 26*b* and the glass member 24*b* to be apart from one another. These sealing metal pieces 27 are respectively connected to the current collection plates 26*a* and 26*b*. Although the number of molybdenum foils are suitably set up according to the current amount supplied to the electrodes, four molybdenum foils are provided in this example. The above mentioned surface treatment is performed on the sealing metal pieces 27 by irradiating the sealing metal pieces 27, each of which are made from a molybdenum foil, with a laser beam whose pulse width of $1\times10^{-9}$ seconds or less, whereby, for example, as shown in FIG. 2D, a surface of the metal piece(s) 27 that is located in a current collection plate 26*a* side close to the electrode and that is in contact with the sealing portion 25 is processed by the surface treatment.

In a state where each sealing metal piece 27 (molybdenum foil) is inserted between the sealing portion 25 and the glass member 24*b*, the sealing portions 25 are respectively heated with a predetermined heating means, thereby causing melting and deformation. In such a case, since the surface treatment is carried out to each of the molybdenum foils, the adhesion strength between the glass and the molybdenum foils increases. In addition, two or more molybdenum foils are electrically connected to the current collection plates 26*a* and 26*b*, respectively, to reduce the amount of current that flows through each molybdenum foil. Moreover, an external lead rod 28 is fixed to each current collection plate 26*b* located in a base side, so that the external lead rod 28 is electrically connected. Each external lead rod 28 is held by the external lead rod holding member 24*c*.

Figure 3A:
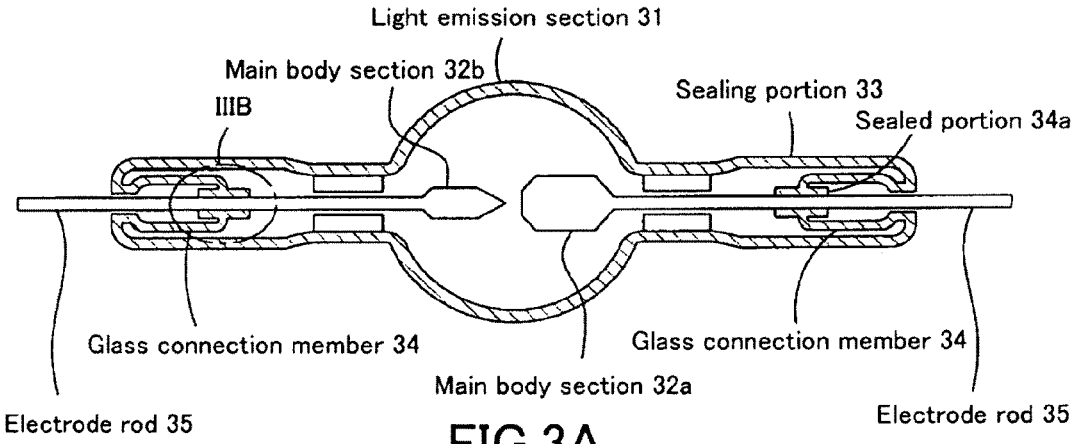
FIGS. 3A and 3B are diagrams showing the structure of the high pressure discharge lamp of a third embodiment of the present invention, wherein sealing metal pieces, to which a surface treatment is performed, are used.
Figure 3B:
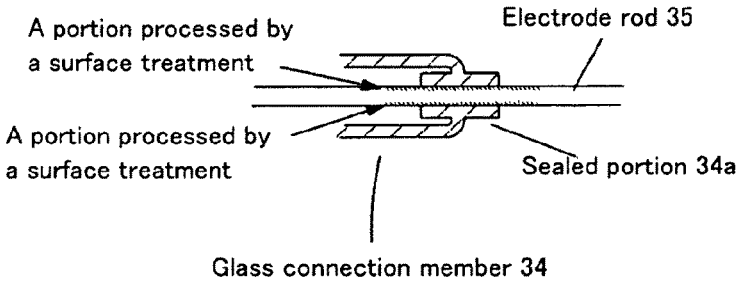

FIGS. 3A and 3B are diagrams showing the structure of a high pressure discharge lamp according to a third embodiment of the present invention, wherein sealing metal pieces, to which a surface treatment is performed, are used for sealing portions. FIG. 3A is a cross sectional view of high pressure discharge lamp, taken in a longitudinal direction. FIG. 3B is a partially enlarged view of a portion of the sealing metal piece (a portion IIIB of FIG. 3A). The high pressure discharge lamp shown in this figure is a short arc type xenon lamp, which is sealed by a connection glass member sealing method. As shown in FIG. 3A, an arc tube is made up of a spherical light emission section 31 and rod shape sealing portions 33 that are continuously formed from the respective ends of the light emission section 31 and made of silica glass. While xenon gas is enclosed in the interior space of the light emission section 31 so that the vapor pressure at time of lighting may become a predetermined pressure, the pair of electrodes is arranged to face each. Each electrode has the main body section (32*a* or 32*b*) and an electrode rod 35 connected to the main body sections 32*a* or 32*b*, which are respectively made of tungsten.

A step connection glass member 34 is arranged inside each of the sealing portions 33, and each of the pair of electrode rods 35 are airtightly sealed by a sealed portion 34*a* of the step connection glass members 34. Therefore, while each electrode rod 35 is a sealing metal piece, a portion, which extends outwards from the sealing portion 33, also serves as a lead rod. As shown in the enlarged view of FIG. 3B, a surface treatment is performed by irradiating a portion of the electrode rod(s) 35, which is fixed to the sealed portion 34*a* of the step connection glass member 34, with the above described laser whose pulse width is $1\times10^{-9}$ seconds or less to increase the adhesion strength between the electrode rod 35 and the step connection glass member 34.

In addition, as described above, although the present invention is applied to the high pressure discharge lamps shown in the first through third embodiments of the present invention, it is possible to apply the present invention to any other high pressure discharge lamp having a sealing portion(s) that are made of glass and sealing metal pieces to raise the adhesion strength by irradiating the sealing portion(s) with the laser whose pulse width is $1\times10^{-9}$ seconds or less. Thus, in the high pressure discharge lamp according to the embodiments of this present invention, the sealing metal piece(s) is irradiated with a laser beam whose pulse width is $1\times10^{-9}$ seconds or less to carry out a surface treatment of the sealing metal piece(s), whereby the sealing portion made of the glass and the sealing metal piece(s) having a particular fine surface structure, is formed to increase the adhesion strength between the sealing metal piece(s) and the glass. Thus, it is possible to expect a remarkably extended life span of the high pressure discharge lamp.

Next, an experimental result regarding the above mentioned surface treatment method of the sealing metal piece(s) for increasing the adhesion strength between the sealing metal piece (s) and the glass will be described below. The sealing portion of the high pressure discharge lamp is classified into two kinds of structures. One of them is a foil seal structure as shown in FIGS. 1A, 1B, 1C, 2A, 2B, 2C, and 2D, and the other one is a rod seal structure as shown in FIGS. 3A and 3B. In a high pressure discharge lamp having such a foil seal structure, metallic foils, such as molybdenum foils, are used for sealing metal pieces. On the other hand, in a high pressure discharge lamp having such a road seal structure, a metal rod such as a tungsten rod, is used for sealing metal pieces. A molybdenum foil as a sealing metal piece in the foil seal structure and a sealing metal piece in the rod seal structure as a tungsten rod will be described below, as examples. However, the sealing metallic pieces are not necessarily limited to those described above, and it is possible to use other various metallic materials. Although a surface treatment is performed to the sealing metal pieces to increase the adhesion strength between the glass that forms an arc tube and the sealing metal pieces, as mentioned above, a case where silica glass is used as material of the arc tube structure will be described below. However, the material of the arc tube structure is not necessarily limited to silica glass, and other glass material can be used.

Figure 4:
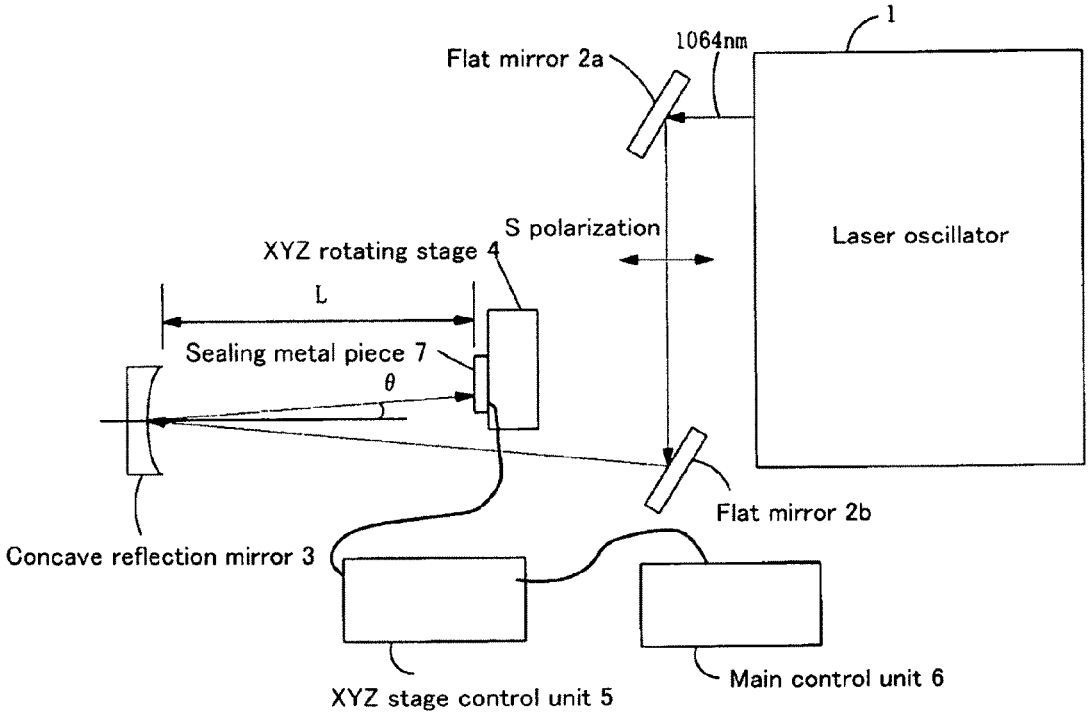
FIG. 4 is a schematic view of the structure of a surface treatment apparatus for performing a surface treatment of a sealing metal piece.

The surface treatment is performed by irradiating a surface of the sealing metal piece with a laser beam whose pulse width is $1\times10^{-9}$ seconds or less, which is described below. FIG. 4 is a schematic view of the structure of a surface treatment apparatus for performing such a surface treatment of a sealing metal piece. The surface treatment apparatus has a laser oscillator 1, a pair of flat mirrors 2*a* and 2*b*, a concave reflection mirror 3, an XYZ rotating stage 4, an XYZ stage control unit 5, and a main control unit 6. The above mentioned picosecond laser oscillator for emitting a laser beam whose pulse width is preferably $2\times10^{-11}$ seconds to $1\times10^{-9}$ seconds, is used as the laser oscillator 1, wherein a laser beam is of a linear polarization. The flat mirrors 2*a* and 2*b* are arranged to reflect the laser beam from the laser oscillator 1 toward the concave reflection mirror 3. The concave reflection mirror 3 whose focal length is, for example, 500 mm and has a reflective surface by which the laser beam, which is incident thereon, is reflected at the same outgoing angle as the incident angle. The performance of the laser oscillator 1 will be described below. The wavelength of the laser is 1,064 nm (YAG laser). The repetition frequency is 1 kHz. Pulse width is 65 picoseconds. An average output is 900-1,000 mW. A peak output is 15 MW. A beam diameter is ϕ0.2 mm. An irradiation power density is 47 GW/cm$^2$. A laser beam of S polarization is emitted.

The sealing metal piece 7, such as a molybdenum foil, a tungsten rod etc., is arranged on the XYZ rotating stage 4. The distance L between the concave reflection mirror 3 and an irradiation face thereof is variable, and, for example, in the case of the surface treatment of the molybdenum foil, the distance is set up to 470 mm, and in the case of the surface treatment of tungsten, the distance is set up to 490 mm. The laser beam of a linear polarization, which is emitted from the laser oscillator 1, is reflected by the pair of flat mirrors 2*a* and 2*b* in that order, to enter to the concave reflection mirror 3, and the laser beam is reflected at the same angle as the incidence angle on the concave reflection mirror 3, so that the sealing metal piece 7, which is arranged on the XYZ rotating stage 4, is irradiated with the laser beam. The sealing metal piece 7 is irradiated with the laser beam, while a scanning operation is performed. While the scanning of a laser beam may be performed by performing a scanning operation of the laser oscillator 1 while the XYZ rotating stage 4 is fixed, or it may be performed by moving the XYZ rotating stage 4 while the laser oscillator 1 is fixed.

Figure 5A:
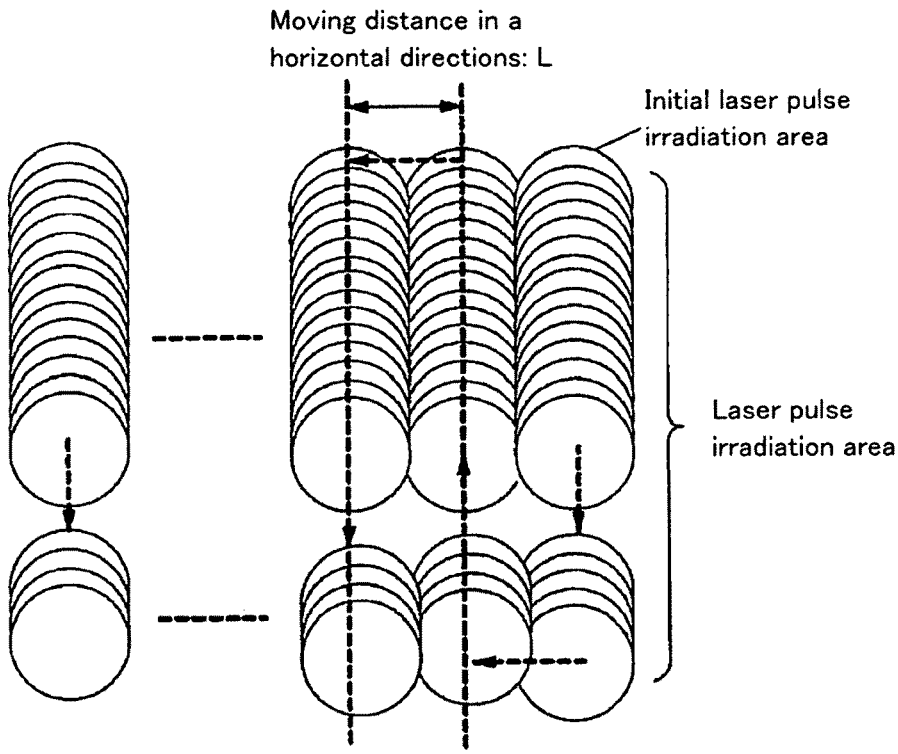
FIGS. 5A and 5B are explanatory diagrams of an irradiation method of a laser beam in a processing treatment of a surface of a sealing metal piece.
Figure 5B:
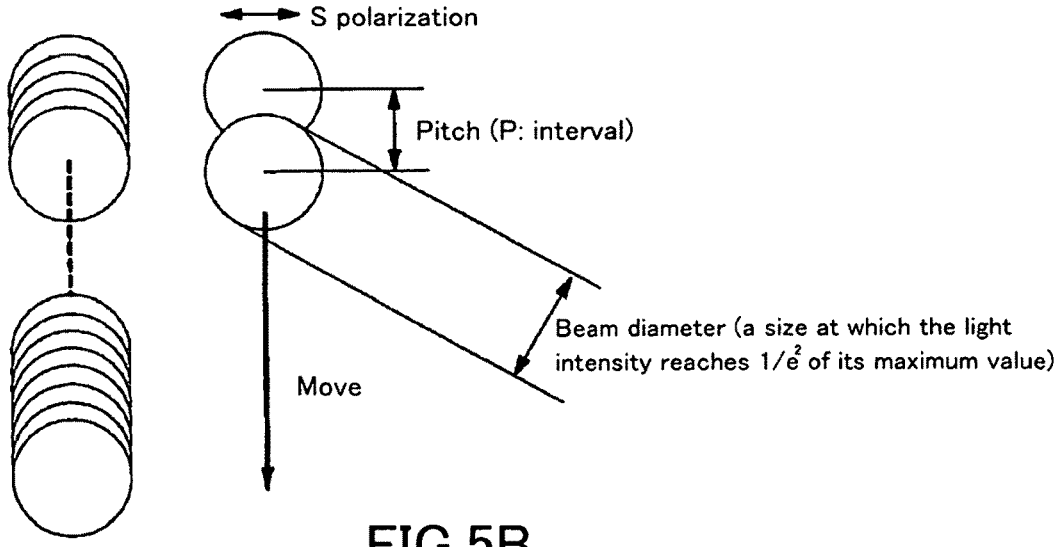

FIGS. 5A and 5B are explanatory diagrams of an irradiation method of picosecond laser in a fine processing treatment of a surface of a sealing metal piece according to an embodiment of the present invention. As shown in FIG. 5A, a surface of the sealing metal piece is irradiated with a laser pulse while the laser is moved in a direction perpendicular to a polarization direction, and the position of the laser is shifted when the laser reaches an end of the irradiation area, and then the laser is moved in a direction opposite to the above. The above operation for irradiating the surface of the sealing metal piece with a laser pulse, is repeated to perform the scanning operation, so that the irradiation areas of the laser pulse may overlap with each other, whereby a surface treatment of the sealing metal piece is performed. The condition of the laser irradiation in this embodiment will be given below. The beam diameter is ϕ0.2 mm. Pulse width is 65 psec and 410 psec. The repeat frequency is 1 kHz. Beam moving speed is 0.5-5 mm/sec. The number of beam overlaps is hundreds of times. Laser energy is 900-1000 μJoule. As shown in FIG. 5B, the irradiation pitch of the laser pulse is expressed in (P: gap), the repeat frequency of laser is expressed in (fkHz), the moving speed is expressed in (V: mm/sec), the diameter of a laser beam is expressed in (D: mmϕ), and the light intensity is expressed as $1/e^2$ of a maximum value ("e" is a natural constant). The conditions, under which a laser pulse overlaps, are pitch P<D, P=V/f (mm), and maximum overlap number=(f/V)/D.

As mentioned above, after irradiating the sealing metal piece such as a molybdenum foil with the laser beam so as to perform the surface treatment to the metal piece, an oxidation removal processing is performed. This is because an oxidization of the surface of the sealing metal piece cannot be avoided, even though the irradiation is performed while spraying rare gas, if the sealing metal piece such as a molybdenum foil is irradiated with the super short pulsed laser whose pulse width is $1\times10^{-9}$ seconds or less. For example, if molybdenum oxide exists on the surface of such a molybdenum foil, the foil may be ripped and weakened at time of sealing. Moreover, oxygen is freed from the molybdenum oxide and remains in the arc tube at the time of sealing, so that the irradiation illuminance maintenance rate may be reduced and/or the instability of arc is induced when the lamp is lighted for a long time. For this reason, it is necessary to remove the oxide formed on the surface of the sealing metal piece, as much as possible. Consequently, the oxide is removed, for example, by exposing it under reduction atmosphere at high temperature. For example, in the oxide removing process of the molybdenum foil performed by a hydrogen treatment, hydrogen gas is injected in the core tube heated to temperature of from 700 to 1,000° C. or less, and then the molybdenum oxide is inserted into the core tube. And after the molybdenum oxide is left for thirty minutes or more in that state, the molybdenum foil, from which oxide is removed, is taken out.

Figure 6A:
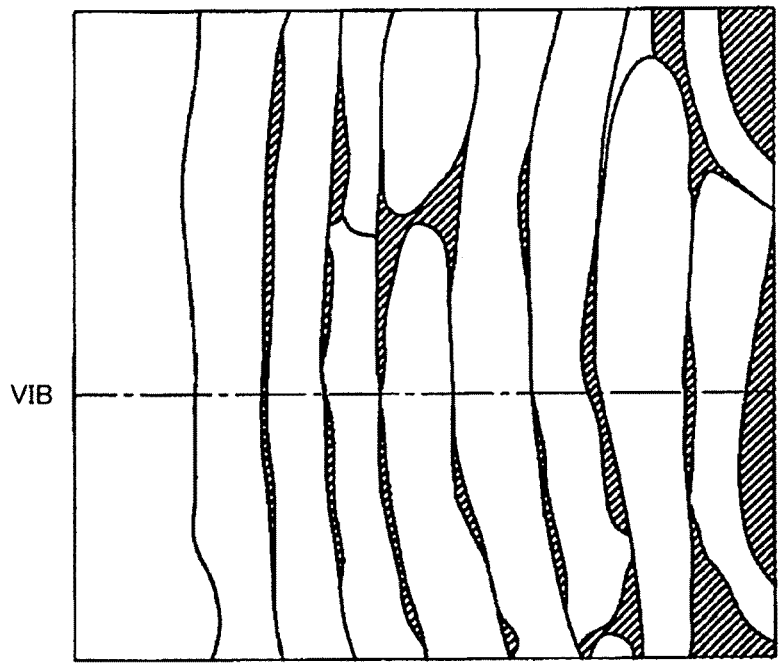
FIGS. 6A and 6B are schematic diagrams showing a fine cycle structure formed by irradiating a metal piece with a laser beam whose pulse width is $2\times10^{-11}$ seconds or less and that was viewed by an atom force microscope.
Figure 6B:
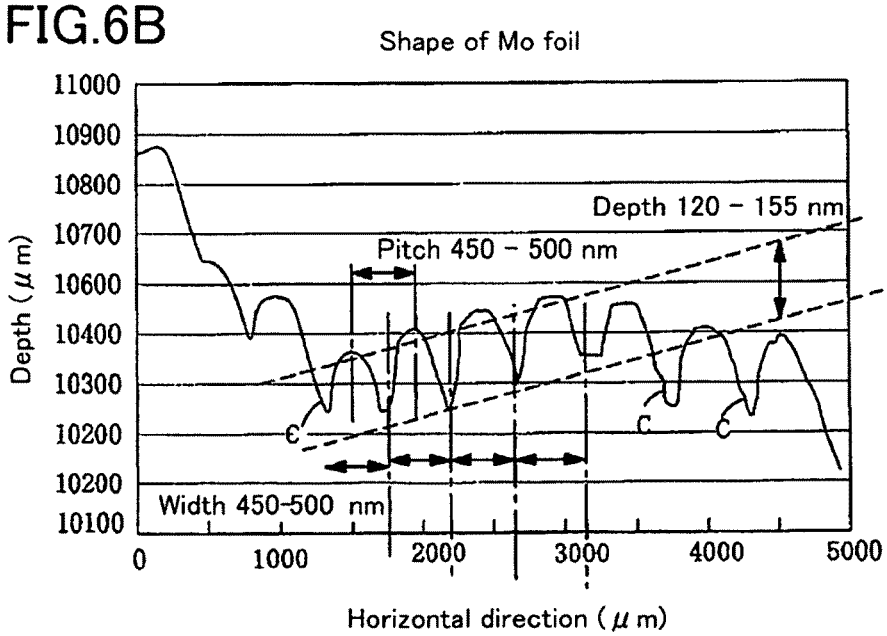

FIGS. 6A and 6B show a schematic image and a schematic cross sectional view of a fine cycle structure formed by irradiating the metal piece such as a molybdenum foil with the laser beam whose pulse width is $2\times10^{-11}$ or less seconds (hereinafter referred to as a femtosecond laser beam), wherein they are taken by an atomic force microscope. Specifically, FIG. 6A is a schematic diagram of the above-mentioned image, and FIG. 6B is a schematic cross sectional view showing the shape of concavity and convexity taken along a line VIB of FIG. 6A. In addition, the irradiation method of the femtosecond laser beam is merely different from that of the picosecond laser beam, in that a femtosecond laser oscillator for outputting the laser beam whose pulse width is $2\times10^{-11}$ seconds or less is used as the laser oscillator 1 for irradiation of the femtosecond laser beam. Other elements are the same as those of the case of irradiation of the picosecond laser beam, which is described above, referring to FIGS. 4, 5A, and 5B. As shown in FIGS. 6A and 6B, long and thin concave grooves C are periodically formed in the polarization direction of the laser beam by irradiating the surface of the molybdenum foil with the femtosecond laser beam. As shown in FIG. 6B, the depths of the grooves are in a range of about 120 nm-155 nm, the width is in a range of about 450 nm-500 nm, and the groove pitches are in a range of about 450 nm-500 nm.

FIGS. 7A and 7B show a schematic image and a schematic cross sectional view of a fine cycle structure formed by irradiating a surface of a molybdenum foil with a picosecond laser beam whose pulse width is $2\times10^{-11}$-$1\times10^{-9}$ seconds, wherein they are viewed by an atomic force microscope. Specifically, FIG. 7A is a schematic diagram of the above-mentioned image, and FIG. 7B is a schematic cross sectional view showing the shape of concavity and convexity taken along the line VIIB of FIG. 7A. In addition, in FIG. 7A, darker-shaded portions show concave portions, and the figure mainly shows the shape of concavity and convexity near a portion along the line VIIB in detail, and part of the shape of concavity and convexity, which is away from the line VIIB, is omitted. As shown in FIG. 7A, long and thin concave grooves C are periodically formed in the polarization direction of the laser beam by irradiating the surface of a molybdenum foil with the picosecond laser beam. As shown in FIG. 7B, the depths of the grooves are in a range of about 200 nm-270 nm, the widths are in a range of about 800 nm-1,200 nm, and the groove pitches are in a range of about 800 nm-1,200 nm.

Figure 9:
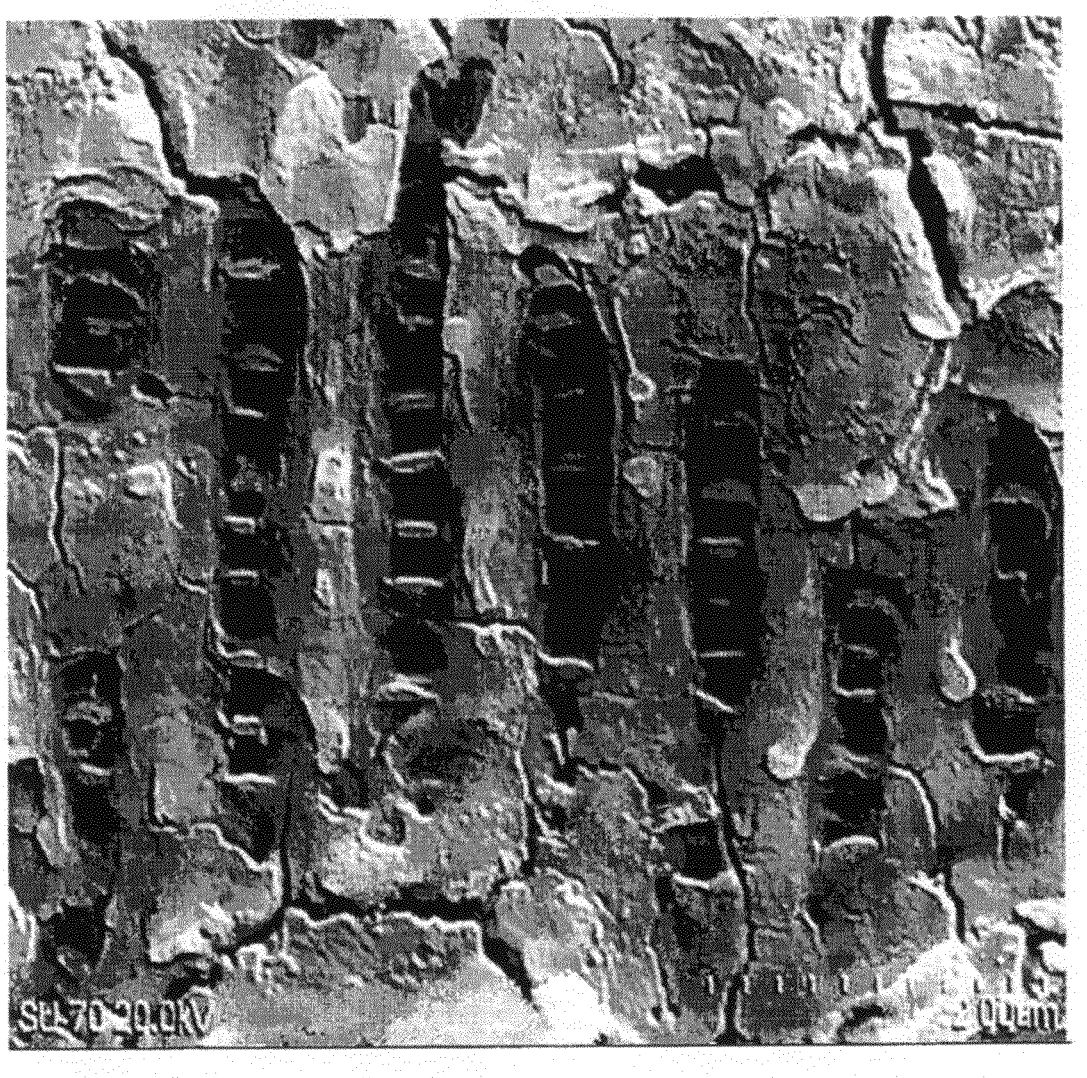
FIG. 9 shows an image of a fine cycle structure formed by irradiating a metal piece with laser beam whose pulse width is $2\times10^{-11}$ to $1\times10^{-9}$ seconds.

FIGS. 8A, 8B, and 8C show a schematic image and schematic cross sectional views of a fine cycle structure formed by irradiating a surface of a molybdenum foil with a picosecond laser beam, wherein they are viewed by an atomic force microscope. FIG. 9 is a diagram showing an image, which is taken by a scanning electron microscope. Specifically, FIG. 8A is a diagram schematically showing the image shown in FIG. 9, and FIGS. 8B and 8C show cross sectional views of the shape of the concavity and convexity, taken along the line VIIIB and a line VIIIC of FIG. 8A, respectively. In addition, in FIG. 8A, darker shaded portions show concave portions. It is observed, in the images of FIGS. 8A and 9 taken by the scanning electron microscope, that the grooves D are formed inside each of the long and thin concave grooves C that are periodically formed in the polarization direction of the laser beam, so that the groove C and the grooves D form a ladder-like groove as a whole, although they are not clearly seen in the image of FIG. 7A taken by the atomic force microscope. Moreover, when the shape in a cross section was observed with the scanning electron microscope while it was inclined, the greatest depth between the ladder-like shapes exceeded 600 nm at a maximum. This phenomenon was observed only when the surface was irradiated with the picosecond laser beam. When the surface was irradiated with the femtosecond laser, the ladder-like grooves D were not observed.

In the present invention, fine concave grooves are formed by irradiating the surface of the molybdenum foil with the laser beam whose pulse width is $2\times10^{-11}$ seconds or less (femtosecond laser beam) to improve the adhesion strength between the sealing metal piece and the glass. Especially, when the surface of the molybdenum foil is irradiated with the laser beam whose pulse width is $2\times10^{-11}$ seconds or less (picosecond laser beam), the fine concave grooves are also formed on the surface of the molybdenum foil similarly to the case where it is irradiated with the femtosecond laser beam. Therefore, when the surface is irradiated with the picosecond laser beam, it is possible to improve the adhesion strength between the sealing metal piece and the glass, similarly to the case where the surface is irradiated with the femtosecond laser beam. Furthermore, when the surface is irradiated with the picosecond laser beam, as described above, the ladder-like grooves D are formed inside long and thin concave grooves C. Thus, a further improvement in the adhesion strength can be expected by these grooves.

FIG. 10 is a table showing performances of the picosecond laser and the femtosecond laser, which were used for the experiment, the depth of formed grooves, width of the grooves, the groove pitch, etc. As shown in the diagram, although there are differences, for example, in the depth of formed groove, the width of groove, and the groove pitch. between the case where the surface was irradiated with the picosecond laser beam and the case where the surface was irradiated with the femtosecond, similar fine structures were formed. Furthermore, when the surface is irradiated with the picosecond laser beam, since the ladder-like grooves were formed in the inside of concave grooves, the same effects as or greater than those in case where the surface treatment is carried out with the femtosecond laser beam are expected. In addition, the depths, the widths and the pitches of the concave grooves, shown in FIGS. 6A, 6B, 7A, 7B, 8A, 8B, 8C, 9, and 10 can be suitably adjusted by changing energy of the laser beam and wavelength.

Figure 11:
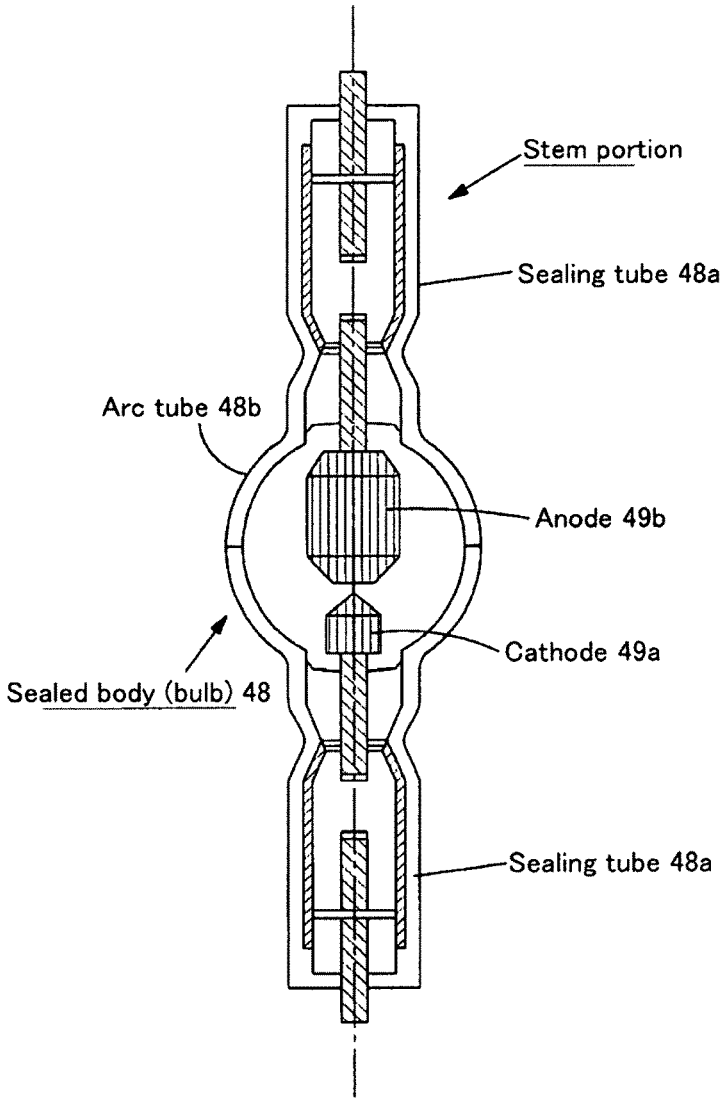
FIG. 11 is a diagram showing a cross sectional view of the structure of a lamp used for an experiment for verifying an effects of the present invention.
Figure 12A:
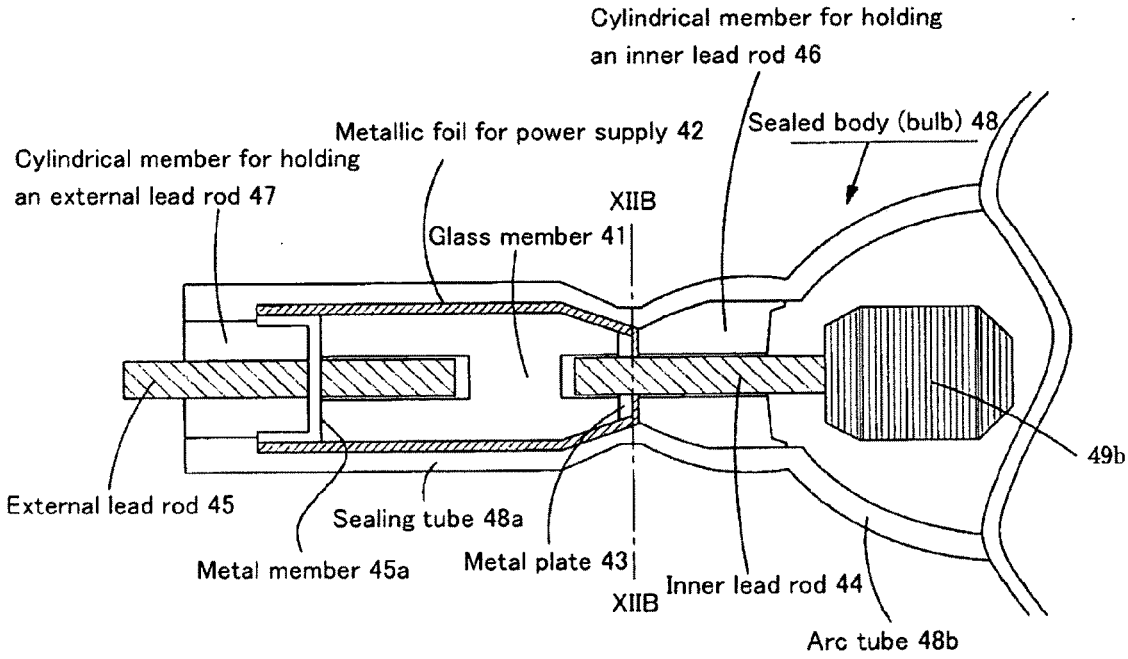
FIGS. 12A and 12B are cross sectional views of the structure of a stem portion of a lamp used for an experiment for verifying an effect of the present invention.
Figure 12B:
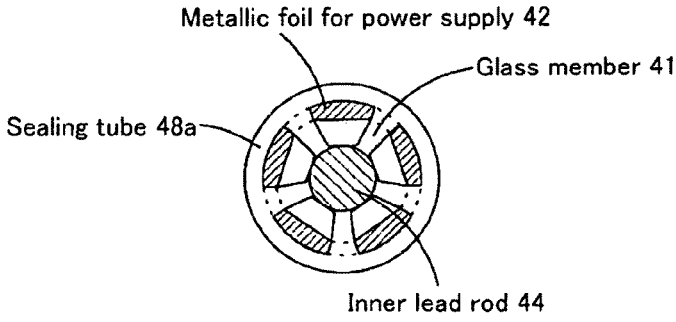

As mentioned above, when the sealing metal piece is irradiated with the laser beam whose pulse width is $1\times10^{-9}$ seconds or less, it is considered that the adhesion strength between the sealing metal piece and the glass can be improved. And, through an experiment, which will be given below, it was confirmed that it was possible to improve the adhesion strength between the sealing metal piece and the glass. FIG. 11 is a cross sectional view of the structure of a discharge lamp used for the experiment for verifying the effects of the present invention. FIGS. 12A and 12B are cross sectional views of the structure of a stem portion of the discharge lamp used for the experiment for verifying the effects of the present invention. Specifically, FIG. 12A shows details of the structure of the stem portion, and FIG. 12B is a cross sectional view, taken along the line XIIB-XIIB of FIG. 12A. As shown in FIGS. 11, 12A and 12B, the discharge lamp is made of optically transparent material, such as silica glass, and comprises an electric discharge container (sealed body) 48 including an approximately spherical arc tube 48*b* and sealing tubes 48*a* that are continuously extending from the respective ends of the approximately spherical arc tube 48*b*. A cathode 49*a* and an anode 49*b*, which are respectively made of, for example, tungsten, are arranged to face each other in the inside of the arc tube 48*b*. In the electric discharge container 48, a predetermined amount of mercury as light-emitting material and a predetermined amount of, for example, xenon gas, as buffer gas for start-up assistance, are enclosed. The amount of mercury to be enclosed is in a range of 1-70 $mg/cm^3$, for example, 22 $mg/cm^3$, and the amount of xenon gas enclosed is in a range of 0.05-0.5 MPa, for example, 0.1 MPa.

As shown in FIGS. 12A and 12B, two or more sheets, for example, five sheets of belt-like metallic foils 42 for electric supply are formed on an outer circumferential surface of a glass member 41 to be apart from one another in a circumferential direction and to be in parallel with one another in a tube axial direction of the discharge lamp. Although the metallic foils 42 for electric supply may be made of high melting point metal, such as molybdenum, tungsten, tantalum, ruthenium, rhenium or alloys, the metallic foils 42 are desirably made of metal whose main component is molybdenum, because the molybdenum is easily welded and has the good conductivity of welding heat. The thickness of each metallic foil 42 for electric supply is, for example, 0.02-0.06 mm and the width is, for example, 6-15 mm. Moreover, a hole, in which an external lead rod 45 with a diameter of 6 mm is inserted, is formed in an end face of each cylindrical member 47 for holding the external lead rod.

One end of each metallic foil 42 for electric supply is electrically connected to an inner lead rod 44. The other end is electrically connected to an external lead rod 45. Specifically, the inner lead rod 44 is supported in a state in which the inner lead rod 44 is inserted in a cylindrical member 46 for holding the inner lead rod, and a metal plate 43 is fixed to a sealing portion side of the inner lead rod 44, wherein the inner lead rod 44 and the metallic foil 42 for electric supply are electrically connected by welding the metallic foils 42 for electric supply to the metal plate 43. The external lead rod 45 inserted in the glass member 41 is supported in a state where the external lead rod 45 is inserted in the cylindrical member 47 for holding the external lead rod, and a metal member 45*a* is provided to cover an outer circumferential surface of the cylindrical member 47 from an end surface in the arc tube side of the cylindrical body 47 for holding external lead rod, and the external lead rod 45 and the metallic foils 42 for electric supply are electrically connected to each other by welding the metallic foil 42 for electric supply to the outer circumferential surface of the metal member 45*a*. The metal member 45*a* is formed by, for example, radially arranging two or more metallic ribbons on the outer circumferential surface of the cylindrical member 47 for holding the external lead rod.

The specification of the discharge lamp used for the experiment will be given below. The distance between electrodes was 7 mm. The enclosure pressure of rare gas, Ar was 5 atmospheric pressure (at room temperature). The amount of enclosed mercury (per lamp internal volume) was 45 mg/cm$^3$. The metallic foil 42 for electric supply of the discharge lamp used for the experiment, was in a shape of trapezoid in which the thickness was 40 μm, the width was 10 mm, the length was 60 mm, a tip width in a metal plate side was 6 mm, and the width became 10 mm at a position of 10 mm from the tip.

Figure 13:
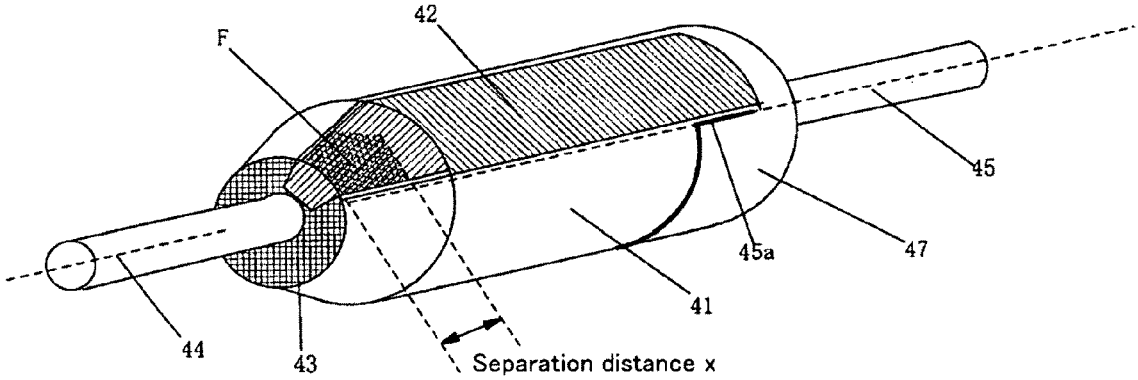
FIG. 13 is a diagram explaining the about portions in which a foil is separated in an experiment for verifying effects.

A standard lamp A0 having a metallic foil for electric supply, which was not irradiated with a laser beam, was prepared, and lamps B1-B3, in each of which a trapezoidal tip portion of the metallic foil 42 for electric supply was irradiated with the laser beam, were made for the experiment. The lamps B1, B2, and B3 were different in that the pulse width of the laser beam, with which the surface was irradiated, was varied, wherein the pulse width of the beam for the lamp B1 was 410 psec, for the lamp B2 was 65 psec, and for the lamp B3 was 30 fsec. Electric power of 6 kW was respectively inputted into the above-mentioned lamps A0, B1, B2, and B3, and acceleration lighting was carried out while these lamps were in a vertical posture by putting the anode up, and whether the metallic foil 42 for electric supply came off was examined. FIG. 13 is a diagram for explaining about portions, in which a foil was separated, in the experiment for verifying the effects, and FIG. 14 shows a result of the experimental.

As shown in FIG. 14, in case of the lamp A0 (without grooves) in which the surface of the metallic foil 42 for electric supply that was in a side of the metal plate 43 arranged on the outer circumferential surface of the glass member 41 was not irradiated with a laser beam, an extremely small space, which is shown as a portion F of FIG. 13 (a portion where a foil came off), was observed between the sealing portion 48*a* and the metallic foil 42 for electric supply. The displacement of the foil, which came off, was 12 mm (the evaluation thereof was no good (x)). A space between the inner lead rod 44 and the cylindrical member 46 for holding the inner lead rod (refer to FIG. 12) was connected to a light-emitting space, and the pressure at time of lighting of the lamp was applied up to an outer end face of the metal plate 43. Therefore, when the internal pressure at time of lighting became high, such as tens atmospheric pressure, a foil separation was observed and developed further with passage of lighting time. And when the foil separation was excessive, a breakage occurred from that portion. On the other hand, as shown in FIG. 14, in the cases of the lamp B1 (with ladder-like grooves), which was irradiated with the laser beam of 410 psec, and the lamp B2 (with ladder-like grooves) which was irradiated with the laser beam of 65 psec, a foil separation distance was 1 mm and good results were obtained (the evaluation thereof was good (○)). Moreover, in the case of the lamp B3 (only concave grooves without ladder-like grooves) in which the metal piece was irradiated with the laser beam of 30 fsec, although a foil separation distance was 4 mm and the result was better than that of the case of the lamp which was not irradiated with a laser beam, a foil separation distance was greater than that in the case where the metal piece was irradiated with the picosecond laser beam (evaluation was not bad, but not good enough (Δ)).

The preceding description has been presented only to illustrate and describe exemplary embodiments of the present high pressure discharge lamp and the present method of manufacturing high pressure discharge lamp. It is not intended to be exhaustive or to limit the invention to any precise form disclosed. It will be understood by those skilled in the art that various changes may be made and equivalents may be substituted for elements without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A high pressure discharge lamp, comprising:

a sealing portion that comprises a glass portion and a sealing metal piece, wherein a surface of the sealing metal piece includes a plurality of elongated grooves formed thereinto and extending generally parallel to one another, each one of the plurality of elongated grooves extending in a lengthwise direction defining a length thereof, in a depthwise direction commencing at the surface of the sealing metal piece and terminating at a bottom to define an elongated groove depth thereof and in a widthwise direction defining a width thereof, with the length being at least twice as large as the width, wherein each one of the elongated grooves includes a plurality of spaced-apart transverse grooves positioned therein and commencing at the bottom of each one of the plurality of elongated grooves and extending into the sealing metal piece to a transverse groove depth, across the widthwise direction to define transverse groove length and in the lengthwise direction to define a transverse groove width, the plurality of transverse grooves forming a ladder-like configuration at the bottom of and inside each one of the plurality of elongated grooves.

2. The high pressure discharge lamp according to claim 1, wherein the surface of the sealing metal piece is an irradiated sealing metal piece surface irradiated by a laser beam to form the plurality of elongated grooves thereinto, the laser beam having a pulse width of $2\times10^{-11}$ seconds to $1\times10^{-9}$ seconds.

3. The high pressure discharge lamp according to claim 1, wherein the sealing metal piece is a foil shape.

4. The high pressure discharge lamp according to claim 1, wherein the sealing metal piece is a rod shape.

5. The high pressure discharge lamp according to claim 1, wherein the depth of each one of the plurality of elongated grooves is at least approximately 120 nm.

6. The high pressure discharge lamp according to claim 1, wherein the width of each one of the plurality of elongated grooves is at least approximately 450 nm.

7. A method of manufacturing the high pressure discharge lamp according to claim 1, comprising:

surface treating the sealing portion, wherein the surface treating further comprises irradiating the sealing metal piece with a laser beam, a pulse width of the laser beam is $1\times10^{-9}$ seconds or less.

8. The method according to claim 7, wherein the pulse width of the laser beam is $2\times10^{-11}$ seconds to $1\times10^{-9}$ seconds.

9. The method according to claim 7, wherein the laser beam is a linear polarization.

10. The high pressure discharge lamp according to claim 2, wherein the laser beam is a linear polarization.

11. A high pressure discharge lamp, comprising:

a sealing portion that comprises a glass portion and a sealing metal piece, wherein the sealing metal piece includes a plurality of elongated grooves formed thereinto and extending generally parallel to one another, each one of the plurality of elongated grooves extending in a lengthwise direction defining a length thereof, a depthwise direction commencing at the surface of the sealing metal piece and terminating at a bottom to define an elongated groove depth thereof and a widthwise direction defining a width thereof, with the length being larger than the width, wherein each one of the elongated grooves includes a plurality of spaced-apart transverse grooves positioned therein and commencing at the bottom of each one of the plurality of elongated grooves and extending into the sealing metal piece to a transverse groove depth, across the widthwise direction to define transverse groove length and in the lengthwise direction to define a transverse groove width, the plurality of transverse grooves forming a ladder-like configuration at the bottom of and inside each one of the plurality of elongated grooves and the depth of each one of the elongated grooves is at least approximately 120 nm.

12. The high pressure discharge lamp according to claim 11, wherein the depth of the plurality of elongated grooves is at least approximately 200 nm.

13. The high pressure discharge lamp according to claim 11, wherein the width of the plurality of elongated grooves is at least approximately 450 nm.

14. The high pressure discharge lamp according to claim 11, wherein the sealing metal piece is a foil shape or a rod shape.

* * * * *